US006814342B1

(12) United States Patent
Perlstein et al.

(10) Patent No.: US 6,814,342 B1
(45) Date of Patent: Nov. 9, 2004

(54) PAD ADAPTERS FOR VEHICLE LIFTS AND METHODS EMPLOYING SAME

(75) Inventors: Steven G. Perlstein, Niskayuna, NY (US); Ronald W. Veresko, Schenectady, NY (US); Rickey D. Wells, Broadalbin, NY (US)

(73) Assignee: Mohawk Resources Ltd., Amsterdam, NY (US)

( * ) Notice: Subject to any disclaimer, the term of this patent is extended or adjusted under 35 U.S.C. 154(b) by 0 days.

(21) Appl. No.: 10/286,376

(22) Filed: Nov. 1, 2002

(51) Int. Cl.[7] ..... B66F 3/00

(52) U.S. Cl. ..... 254/1; 254/90; 254/133 R; 254/88

(58) Field of Search ..... 254/1, 90, 133 R, 254/134, 89 H, 93 R, 88; 187/210, 216, 213, 214, 203, 240, 267, 268

(56) References Cited

U.S. PATENT DOCUMENTS

| | | | | | |
|---|---|---|---|---|---|
| 2,552,974 | A | | 5/1951 | Johnson | 254/89 |
| 3,687,234 | A | * | 8/1972 | Gendreau | 187/267 |
| 3,724,602 | A | | 4/1973 | Hernick | 187/8.54 |
| 3,877,548 | A | | 4/1975 | Hernick | 187/8.43 |
| 3,921,762 | A | | 11/1975 | Provine, III | 187/8.75 |
| 3,958,664 | A | * | 5/1976 | Perkins | 187/209 |
| 4,084,790 | A | * | 4/1978 | Molnar | 187/215 |
| 4,194,726 | A | * | 3/1980 | Hance | 254/133 R |
| 4,212,374 | A | | 7/1980 | Bubik | 187/8.43 |
| 4,238,114 | A | * | 12/1980 | Migliorati | 254/88 |
| 4,267,901 | A | | 5/1981 | Tsujimura | 187/8.54 |
| 4,434,872 | A | | 3/1984 | Daniels, Jr. | 187/8.74 |
| 5,127,638 | A | * | 7/1992 | Kent | 269/17 |
| 5,131,500 | A | | 7/1992 | Hernick | 187/8.43 |
| 5,803,206 | A | * | 9/1998 | Halstead et al. | 187/208 |
| 5,915,500 | A | | 6/1999 | Weaver | 187/216 |
| 5,937,972 | A | * | 8/1999 | Andre | 187/210 |
| 5,954,160 | A | | 9/1999 | Wells, Sr. et al. | 187/219 |
| 6,173,941 | B1 | * | 1/2001 | Johnston | 254/88 |
| 6,314,602 | B1 | * | 11/2001 | Wallen | 14/69.5 |

* cited by examiner

*Primary Examiner*—Robert C. Watson
(74) *Attorney, Agent, or Firm*—Heslin Rothenberg Farley & Mesiti P.C.

(57) ABSTRACT

A pad adapter for vehicle lifts includes a pad releasably attachable to the pivoting arms of a pivoting arm lift to enable the pivoting arm lift to be used as a frame engaging pad lift. The pad adapter includes a platform for engaging the frame of the vehicle and may include pockets for receiving the pivoting arms of the lift, pins for releasebly engaging the pivoting arms, and ramps to facilitate driving a vehicle over the pad adapter.

36 Claims, 5 Drawing Sheets

PAD ADAPTERS FOR VEHICLE LIFTS AND METHODS EMPLOYING SAME

TECHNICAL FIELD

The present invention relates to vehicle lifts, and more particularly to pad adapters and methods for converting pivoting arm lifts into pad engaging lifts.

BACKGROUND OF THE INVENTION

Vehicle lifts are often used to access the underside of vehicles for maintenance purposes. For example, in a car or truck, the engine oil is typically changed from beneath the vehicle. It is more convenient when changing the oil to raise the vehicle to allow maintenance personnel to stand, rather than lie, under the vehicle.

FIG. 1 illustrates a conventional twopost pivoting arm lift 10 having two spaced-apart posts 12. Each post has two pivoting arms 14 and 16 which engage the frame of the vehicle (only one set of arms numbered in FIG. 1). For each post, one pivoting arm engages a front portion of the vehicle, while the other pivoting arm engages a rear portion of the vehicle. The pivoting arms are also telescopeably adjustable. In use, each of the pivoting arms are adjusted and positioned under appropriate lifting points of the frame of the vehicle.

Other types of vehicle lifts include one or two post lifts having a pair of fixedly attached runways for lifting a vehicle by its wheels, two post lifts having fixedly attached pads for engaging and lifting the frame of a vehicle, and scissor lifts having a pair of spaced-apart, fixedly-attached pads for engaging and lifting the frame of a vehicle.

There is a need for pad adapters for converting pivoting arm lifts into frame engaging pad lifts.

SUMMARY OF THE INVENTION

In a first aspect, the present invention provides a pad adapter for use in converting a pivoting arm lift having a plurality of pivoting arms into a frame engaging pad lift for lifting a vehicle. The pad adapter includes a pad releasably attachable to at least two of the plurality of pivoting arms. The pad also includes a platform for engaging the frame of the vehicle.

In a second aspect, the present invention provides a pad adapter for converting a pivoting arm lift having a pair of pivoting arms into a frame engaging pad lift for lifting a vehicle. The pad adapter includes a pair of pockets for receiving and releasably attaching to the pair of pivoting arms. The pad also includes a platform for engaging the frame of the vehicle. A pair of pins are attached to the platform and downwardly depend in each of the pockets to releasably attach to the pair of pivoting arms. A pair of ramps are attached to opposite ends of the pad.

In a third aspect, the present invention provides a method for converting a pivoting arm lift having a plurality of pivoting arms into frame engaging pad lift for lifting a vehicle. The method includes providing a pad adapter as described above, and attaching the pad adapter to the at least two of the plurality of pivoting arms or to the pair of pivoting arms.

In a fourth aspect, the present invention provides a method for converting a two-post pivoting arm lift having a first post and a second post into frame engaging pad lift for lifting a vehicle. The method includes attaching a first pad adapter to at least two of a plurality of pivoting arms of the first post, and attaching a second pad adapter to at least two of a plurality of pivoting arms of the second post.

In a fifth aspect, the present invention provides a kit for converting a pivoting arm lift having a first post and a second post into a frame engaging pad lift for lifting a vehicle. Each of the first and second posts has a plurality of pivoting arms. The kit includes a pair of pad adapters and each of the pad adapters is attachable to at least two pivoting arms.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

Figure 1:
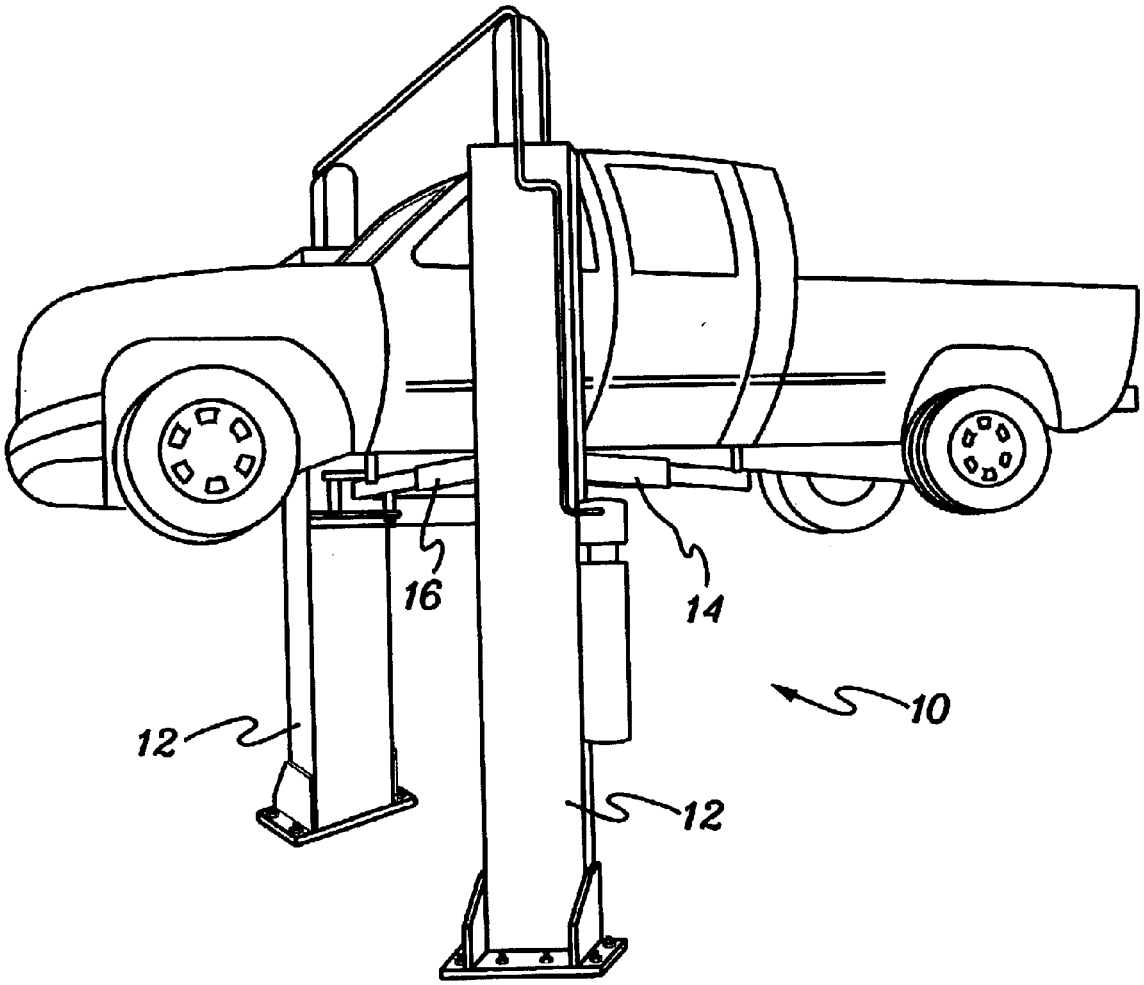
fig. 1 PRIOR ART
FIG. 1 is a perspective view of a conventional pivoting arm lift for use in lifting a vehicle.
Figure 2:
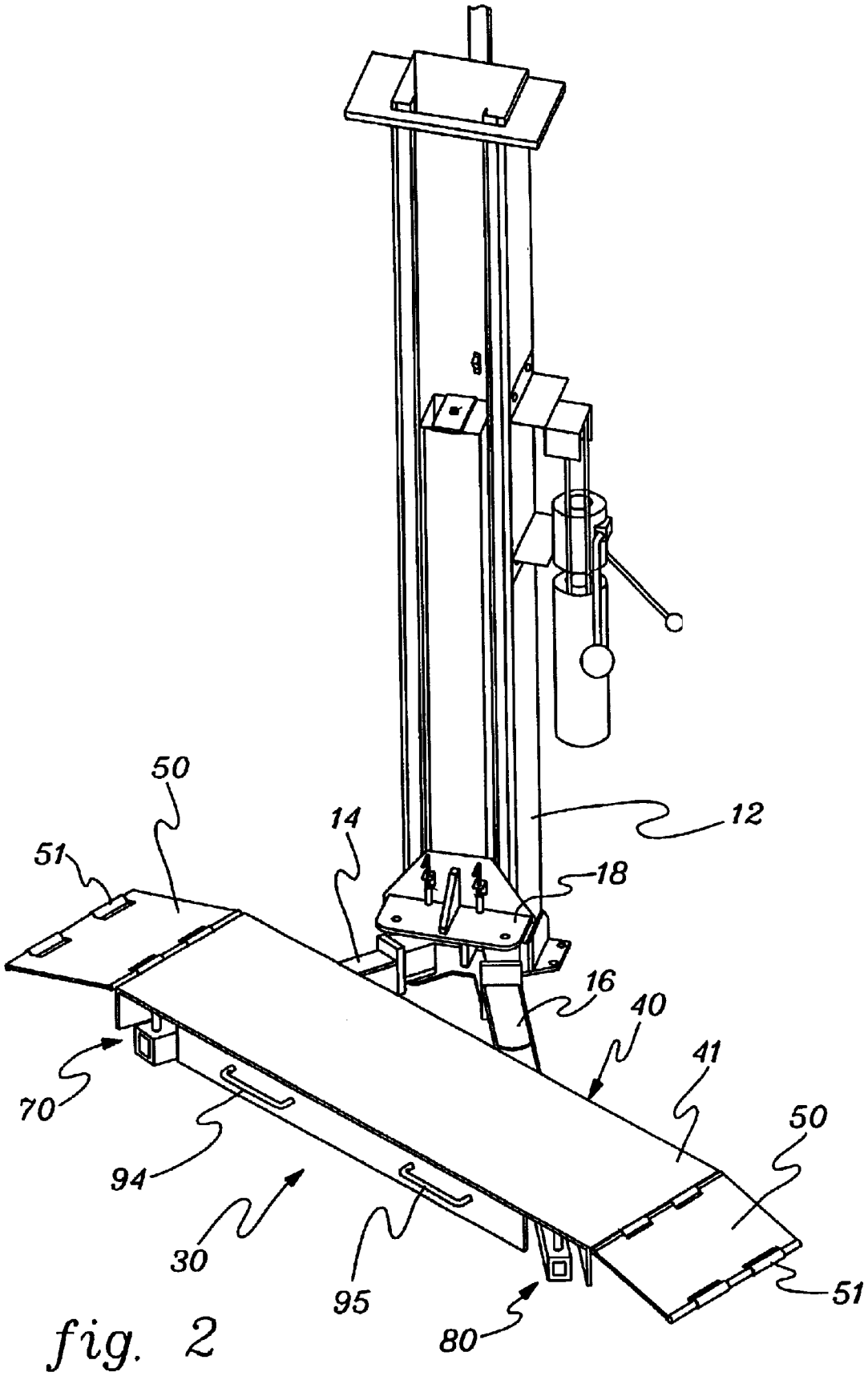
FIG. 2 is an enlarged perspective view of one of the posts of the pivoting arm lift shown in FIG. 1 attached to a pad adapter in accordance with the present invention.

FIG. 2 illustrates a pad adapter 30 in accordance with the present invention. As described in greater detail below, a pair of pad adapters allows for readily and quickly converting a two post pivoting arm lift into a frame engaging pad lift. As the present invention allows for the dual use of a pivoting arm lift either as a pivoting arm lift or as a frame engaging pad lift, such a pad adapter eliminates the need to buy two different types of lifts and reduces the floor space required for the two different types of lifts. The pad adapter also adds flexibility in that one side of the lift can be used as a pivoting arm lift while the other side is simultaneously used as a frame engaging pad lift.

With reference still to FIG. 2, pad adapter 30 is attachable to and spans between pivoting arms 14 and 16 of post 12 of a two post lift so that the lift can be used as a frame engaging pad lift. Pad adapter 30 generally includes a pad 40 and may include a pair of ramps 50 extending from opposite ends of pad 40. Pad 40 may include a generally rectangularly shaped platform 41 which is sized to extend between the wheels of the vehicle and includes a first pocket 70 and a second pocket 80 sized and configured for receiving and releasably attaching to pivoting arms 14 and 16, respectively.

Figure 3:
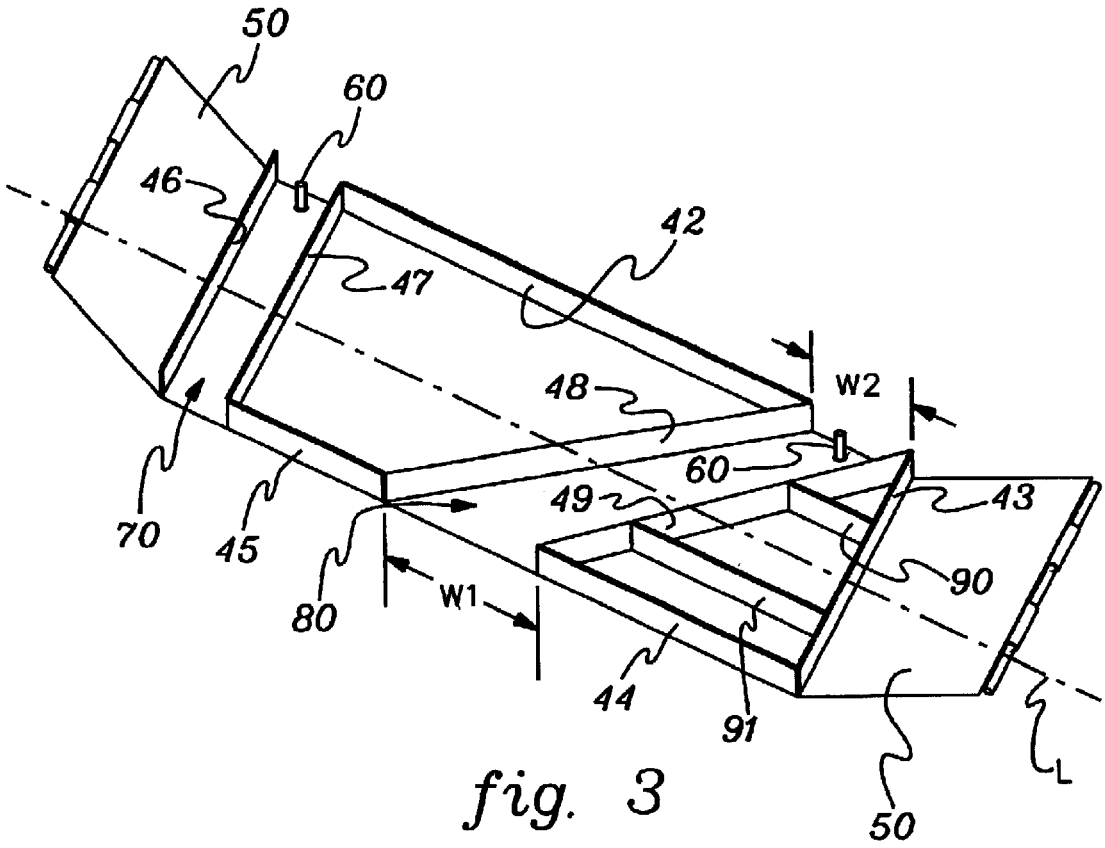
FIG. 3 is a bottom perspective view of the pad adapter shown in FIG. 2.

With reference to FIG. 3, pad adapter 30 may include a plurality of ribs or sidewalls 42, 43, 44, 45, 46, 47, 48, and 49 which downwardly-depend from a bottom surface of platform 41. Sidewalls 46 and 47 define first pocket 70 for receiving and releasably attaching to pivoting arm 14 (FIG. 2). Sidewalls 48 and 49 define second pocket 80 for receiving and releasably attaching to pivoting arm 16 (FIG. 2). Sidewall 47 may be generally parallel with sidewall 46 and both may be generally perpendicular to a longitudinal axis L.

Sidewalls 48 and 49 may be disposed on an angle or non-perpendicularly relative to longitudinal axis L. In addition, sidewalls 48 and 49 may be disposed at an angle or at non-parallel orientations relative to one another so that they form a tapered pocket having a width W1 at one end and a width W2 at an opposite end. The end of pocket 80 for initially receiving pivoting arm 16 (FIG. 2) may have width W1 which is greater than width W2 at the other end. This configuration of a tapered pocket allows pivoting arm 16 (FIG. 2) to attach to pad adapter 30 over a range of angular positions relative to post 12 (FIG. 2).

Pockets 70 and 80 allow the pad adapter to be placed over and span between the pivoting arms with the bottom of the sidewalls resting on the floor. The pad adapter initially supports and transmits forces directly to the floor, e.g., the weight of the vehicle as it rolls over the pad adapter, thereby protecting the pivoting arms. The sidewalls of the pad adapter may also include a laterally-extending flange disposed at the bottom end thereof to provide an increased seating surface area and improved mechanical properties of the pad. In addition, further ribs or sidewalls such as sidewalls 90 and 91 may be provided to increase the strength of the pad. Each pocket may be formed by a C-channel or C-channel assembly. For example, the web of the C-channel may be attached to the platform and the flanges of the C-channel may define the sides of the pocket.

As best shown in FIG. 3, pad adapter 30 may also include a pair of downwardly-depending pins 60 attached to platform 41, each being disposed in one of the pockets. The pins may be received in holes or recesses disposed in the pivoting arms, located near the distal end of the pivoting arms and having a slightly larger size than the size of the pins. The pins support lateral loads and serve to hold the pad adapter in the proper position relative to the pivoting arms during lifting operations.

With reference again to FIG. 2, ramps 50 may be pivotally attached to pad 30, such as by a hinged joint, that allows the ramps to rotate about the joint. For each ramp, the distal end may include one or more rollers 51 which allows the ends of the ramp to roll along the floor as the pad separates from and as the pad approaches the floor during lifting and lowering of a vehicle. Rollers 51 may be formed from a plastic material or other suitable material to reduce the likelihood of damaging the floor.

From the present description, it will be appreciated by those skilled in the art that a pad adapter for use on one post of a two-post frame engaging arm lift may have a mirror image of the structure of a pad adapter for use on the other post. The pad may be equipped with one or more handles attached to a sidewall, such as handles 94 and 95, which allow for ease of maneuverability.

In operation to lift a vehicle, two pad adapters are positioned over the pivoting arms of the 2-post pivoting arm lift which may be set up asymmetrically, and spaced-apart a distance generally corresponding to the width of the vehicle. The vehicle would then be driven between the posts and over the pad adapters to a position such that the wheels of the vehicle straddle and clear the pad adapters with the desired part of the frame positioned above the pad adapters. Once the vehicle and pad adapters are properly situated, the lift is used as a two-post frame engaging pad lift. The lift is actuated to translate the pivoting arms and pad adapters vertically upwards. The top surface of the pad adapters will contact and engage the frame of the vehicle and support the weight of the vehicle as the vehicle is lifted off the ground.

Figure 4:
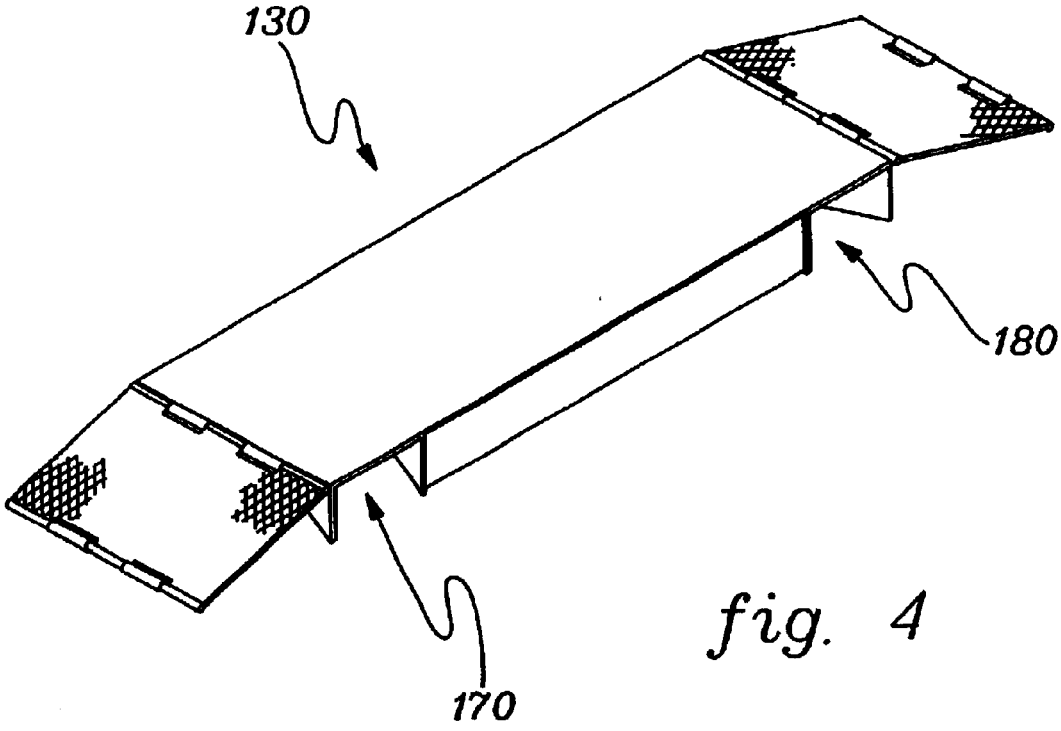
FIG. 4 is a perspective view of another pad adapter in accordance with the present invention.
Figure 5:
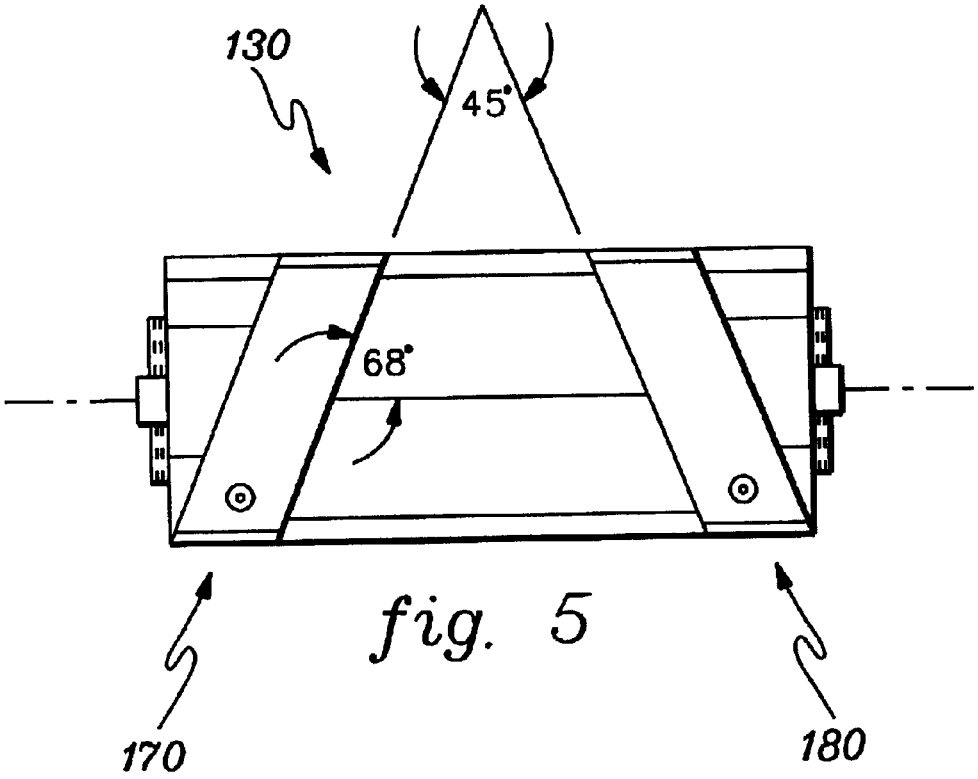
FIG. 5 is a bottom view of the pad adapter of FIG. 4.

FIGS. 4 and 5 illustrate another embodiment of a pad adapter 130 in accordance with the present invention. In this illustrated embodiment, pad adapter 130 is configured for readily and quickly converting a pivoting arm lift setup symmetrically into frame engaging pad lift. Pad adapter 130 is similar to pad adapter 30 with the exception that each of the pockets is disposed on and angle relative to the length of the pad adapter. For example, pockets 170 and 180 may be disposed at an angle of about 45 degrees from each other and at an angle of about 68 degrees from the longitudinal axis of the pad adapter.

Figure 6:
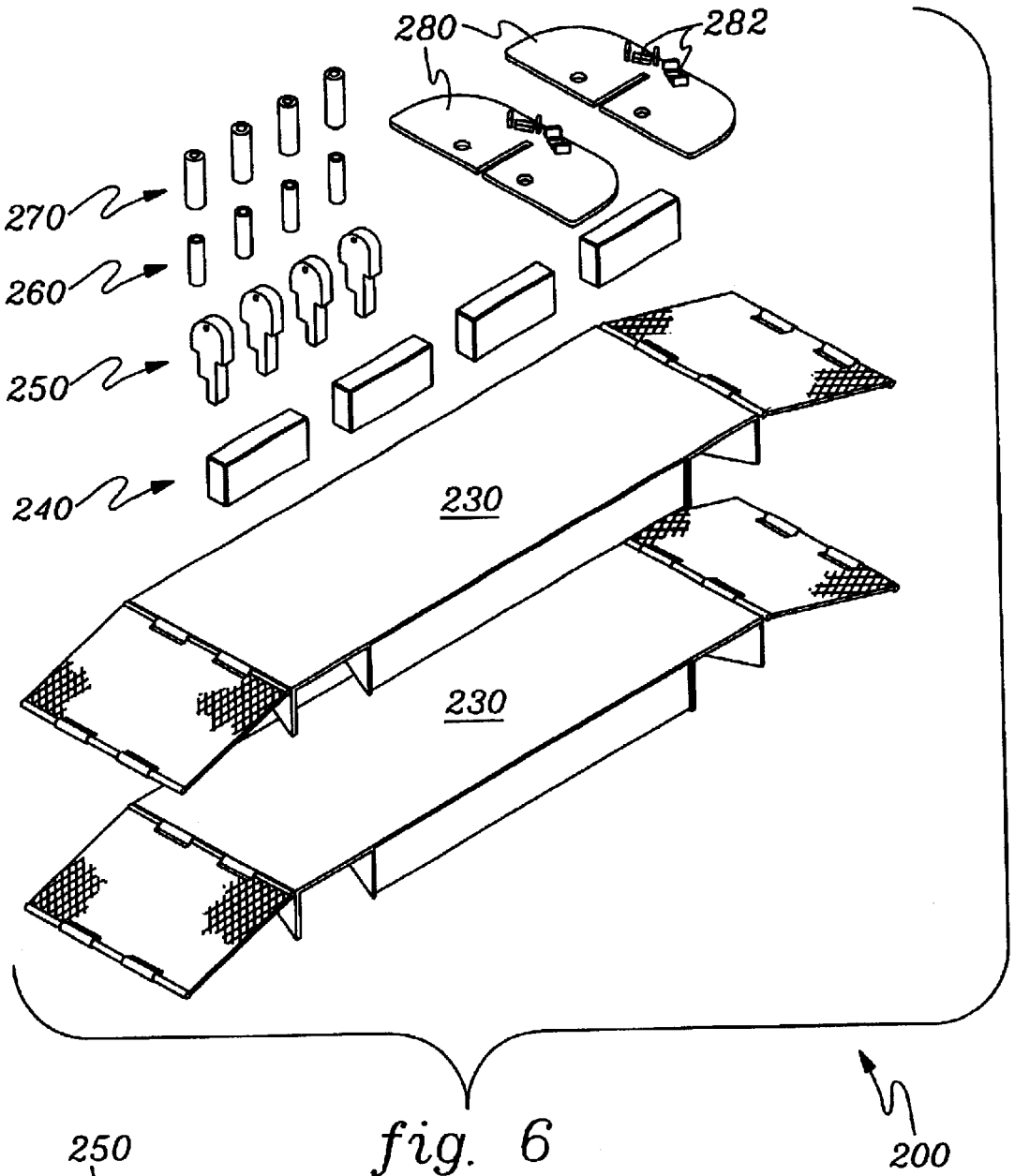
FIG. 6 is a perspective view of a pad adapter kit in accordance with the present invention.

FIG. 6 illustrates a pad adapter kit 200 in accordance with the present invention. Pad adapter kit 200 includes a pair of pad adapters 230, a plurality of rubber blocks 240, a plurality of arm lock keys 250, a first plurality of adapter pins 260 having a first sized diameter, a second plurality of adapter pins 270 having a second sized diameter, and a pair of arm lock weldments 280.

The rubber blocks may be positioned between the platform of the pad adapter and the frame of a vehicle when the pad adapters are used to lift a vehicle. The pin adapters may include a threaded socket which attaches to a downwardly-depending threaded bolt (not shown in FIG. 6) in the pockets. The pin adapters having different sized diameters can be used with swing arms having different sized holes at the distal end thereof.

Figure 7:
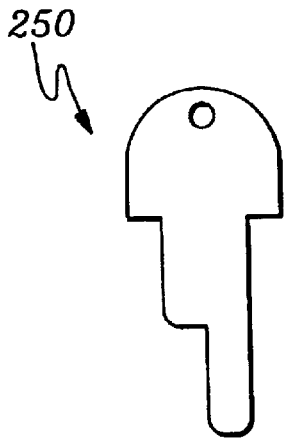
FIG. 7 is an enlarged elevational view of the arm lock key of FIG. 6.

Each arm lock weldment 280 may be placed over a carriage 18 (FIG. 2) of the lift and a pair of arm lock keys may be place in slots 282 so as to extend between the swing arms of the lift. The pair of arm lock pins prevents the swing arms, once inserted in the pockets of the pad adapter, from pivoting relative to each other and the to lift. As best shown in FIG. 7, the arm lock key may have a first width and a second width which is different from the first width. The different widths of the arm lock key allows locking swing arm have different widths.

The platform of the disclosed pad adapters may be about 48 inches long and about 23 inches wide so the pad adapter is usable with small vehicles. The ramps may also be formed out of expanded metal which when driving the vehicle over the pad adapters increases the traction of the wheels. The disclosed pad adapters may also be made out of aluminum or other suitable material to reduce the weight compared with a pad adapter made from steel.

While the invention has been particularly shown and described with reference to certain embodiments, it will be understood by those skilled in the art that various changes in form and details may be made to the invention without departing from the spirit and scope of the invention as described in the following claims.

What is claimed is:

1. A pad adapter for use in converting a pivoting arm lift having a plurality of pivoting arms into a frame engaging pad lift for lifting a vehicle, said pad adapter comprising:

a pad releasably attachable to at least two of the plurality of pivoting arms;

said pad having a platform means for engaging the frame of the vehicle between the wheels of the vehicle; and wherein said platform means extends between the at least two pivoting arms.

2. The pad adapter of claim 1 wherein said pad comprises at least two pockets for receiving the at least two pivoting arms.

3. The pad adapter of claim 1 wherein said pad comprises downwardly-depending walls defining said at least two pockets.

4. The pad adapter of claim 2 wherein one of said at least two pockets is disposed perpendicularly to a longitudinal axis of the pad and a second of said at least two pockets is disposed non-perpendicularly to the longitudinal axis of the pad.

5. The pad adapter of claim 2 wherein one of said at least two pockets comprises a uniform width and a second of said at least two pockets comprises a non-uniform width.

6. The pad adapter of claim 2 wherein said at least two pockets is disposed at an angle relative of the longitudinal axis of the pad.

7. The pad adapter of claim 1 further comprising a plurality of pins attachable to said pad and releasably attachable to the at least two pivoting arms.

8. The pad adapter of claim 1 further comprising a pair of ramps, each ramp being attached to an opposite end of said pad.

9. The pad adapter of claim 8 wherein each of said ramps is pivotally attached to the opposite end of said pad.

10. The pad adapter of claim 9 wherein each of said ramps comprises at least one roller disposed at a distal end of the ramp.

11. The pad adapter of claim 9 wherein each of said ramps comprises expanded metal.

12. The pad adapter of claim 1 further comprising at least one handle attachable to said pad.

13. A pad adapter for converting a pivoting arm lift having a pair of pivoting arms into a frame engaging pad lift for lifting a vehicle, said pad adapter comprising:

a pad comprising a pair of pockets for receiving and releasably attaching to the pair of pivoting arms;

said pad having a platform for engaging the frame of the vehicle;

a pair of pins attached to said platform, one of said pins downwardly-depending in one of said pockets and the other of said pins downwardly-depending in the other of said pockets, said pins being releasably attachable to the pair of pivoting arms; and a pair of ramps, each ramp being attached to an opposite end of said pad.

14. The pad adapter of claim 13 wherein the platform extends between the pair of pivoting arms and is sized for engaging the frame of the vehicle between the wheels of the vehicle.

15. The pad adapter of claim 13 wherein one of said pockets is disposed perpendicularly to a longitudinal axis of said pad and the other of said pockets is disposed non-perpendicularly to the longitudinal axis of said pad.

16. The pad adapter of claim 13 wherein one of said pockets comprises a uniform width and the other of said pockets comprises a non-uniform width.

17. The pad adapter of claim 13 wherein said pair of pockets is disposed at an angle relative of the longitudinal axis of the pad.

18. The pad adapter of claim 13 wherein said pair of ramps are pivotally attached to opposite ends of said pad, and each of said ramps comprising a roller disposed at a distal end of the ramp.

19. A method for converting a pivoting arm lift having a plurality of pivoting arms into frame engaging pad lift for lifting a vehicle, the method comprising:

providing a pad adapter comprising:

a pad releasably attachable to at least two of the plurality of pivoting arms:

said pad having a platform means for engaging the frame of the vehicle between the wheels of the vehicle; and attaching the pad adapter to at least two of the plurality of pivoting arms.

20. The method of claim 19 wherein the pad adapter comprises at least two pockets and the attaching comprises receiving the at least two pivoting arms in the at least two pockets.

21. The method of claim 19 wherein the pad adapter comprises at least two pins and the attaching comprises attaching the at least two pins to the at least two pivoting arms.

22. The method of claim 19 further comprising positioning the vehicle and the pad adapter so that the pad adapter is under the vehicle and engaging the pad adapter with the frame of the vehicle between the wheels to lift the vehicle.

23. A method for converting a pivoting arm lift having a pair of pivoting arms into frame engaging pad lift for lifting a vehicle, the method comprising:

providing a pad adapter comprising:

a pad comprising a pair of pockets for receiving and releasably attaching to the pair of pivoting arms;

said pad having a platform for engaging the frame of the vehicle;

a pair of pins attached to said platform, one of said pins downwardly-depending in one of said pockets and the other of said pins downwardly-depending in the other of said pockets, said pins being releasably attachable to the pair of pivoting arms; and a pair of ramps, each ramp being attached to an opposite end of said pad; and attaching the pad adapter to the pair of pivoting arms.

24. The method of claim 23 wherein the pad adapter comprises a pair of pockets and the attaching comprises receiving the pair of pivoting arms in the pair of pockets.

25. The method of claim 23 wherein the pad adapter comprises a pair of pins and the attaching comprises attaching the pair of pins to the pair of pivoting arms.

26. The method of claim 23 further comprising positioning the vehicle and the pad adapter so that the pad adapter is under the vehicle, and engaging the frame of the vehicle between the wheels to lift the vehicle.

27. A method for converting a pivoting arm lift having a first post and a second post into a frame engaging pad lift for lifting a vehicle, each of the first and second posts having a plurality of pivoting arms, the method comprising:

attaching a first pad adapter to at least two of the plurality of pivoting arms of the first post;

attaching a second pad adapter to at least two of the plurality of pivoting arms of the second post; and engaging the first and second pad adapters with the frame of the vehicle between the wheels to lift the vehicle.

28. The method of claim 27 further comprising positioning the vehicle so that the vehicle is disposed between the first and the second posts and under the first pad adapter and the second pad adapter.

29. A kit for converting a pivoting arm lift having a first post and a second post into a frame engaging pad lift for lifting a vehicle, each of the first and second posts having a plurality of pivoting arms, the kit comprising:

a pair of pad adapters, each pad adapter attachable to at least two pivoting arms; and at least one of a plurality of rubber blocks, and a first plurality of adapter pins having a first diameter and a second plurality of adapter pins having a second diameter different from the first diameter.

30. The kit of claim 29 further comprising a plurality of rubber blocks.

31. The kit of claim 29 further comprising a first plurality of adapter pins having a first diameter and a second plurality of adapter pins having a second diameter different from the first diameter.

32. The kit of claim 29 further comprising a pair of arm lock weldments for placing over a carriage of the lift, and a plurality of arm lock keys disposable in slots in the arm lock weldments so as to extend between the swing arms of the lift.

33. A pad adapter for use in converting a pivoting arm lift having a plurality of pivoting arms into a frame engaging pad lift for lifting a vehicle, said pad adapter comprising:

a pad releasably attachable to at least two of the plurality of pivoting arms;

said pad having a platform means for engaging the frame of the vehicle between the wheels of the vehicle; and wherein said pad comprises downwardly-depending walls defining at least two pockets.

34. A pad adapter for use in converting a pivoting arm lift having a plurality of pivoting arms into a frame engaging pad lift for lifting a vehicle, said pad adapter comprising:

a pad releasably attachable to at least two of the plurality of pivoting arms;

said pad having a platform for engaging the frame of the vehicle; and wherein said pad comprises at least two pockets for receiving the at least two pivoting arms, and one of said at least two pockets comprises a uniform width and a second of said at least two pockets comprises a non-uniform width.

35. A pad adapter for use in converting a pivoting arm lift having a plurality of pivoting arms into a frame engaging pad lift for lifting a vehicle, said pad adapter comprising:

a pad releasably attachable to at least two of the plurality of pivoting arms;

said pad having a platform for engaging the frame of the vehicle; and a plurality of pins attachable to said pad and releasably attachable to the at least two pivoting arms.

36. A method for converting a pivoting arm lift having a plurality of pivoting arms into frame engaging pad lift for lifting a vehicle, the method comprising:

providing a pad adapter having a pad releasably attachable to at least two of the plurality of pivoting arms, a platform for engaging the frame of the vehicle, and at least two pins; and attaching the at least two pins of the pad adapter to at least two of the plurality of pivoting arms.

* * * * *

UNITED STATES PATENT AND TRADEMARK OFFICE

CERTIFICATE OF CORRECTION

PATENT NO. : 6,814,342 B1
DATED : November 9, 2004
INVENTOR(S) : Perlstein et al.

It is certified that error appears in the above-identified patent and that said Letters Patent is hereby corrected as shown below:

Column 4,
Line 60, delete the number "1" and insert -- 2 --.

Signed and Sealed this

Twenty-third Day of August, 2005

JON W. DUDAS
*Director of the United States Patent and Trademark Office*